US006074268A

United States Patent [19]

Uenishi

[11] Patent Number: 6,074,268

[45] Date of Patent: Jun. 13, 2000

[54] SPACE ACCESSORIES

[76] Inventor: Noboru Uenishi, 12 Thomas La., Scarsdale, N.Y. 10583

[21] Appl. No.: 09/134,244

[22] Filed: Aug. 14, 1998

[51] Int. Cl.[7] ..... A63H 33/40

[52] U.S. Cl. ..... 446/217; 446/112; 446/113; 446/236; 40/440

[58] Field of Search ..... 446/217, 218, 446/108, 111, 112, 113, 236, 243, 244, 245; 40/422, 440, 446, 477, 479; D21/458, 465, 467; 428/9, 11, 542.6

[56] References Cited

U.S. PATENT DOCUMENTS

| | | | |
|---|---|---|---|
| D. 335,593 | 5/1993 | France . | |
| 1,501,251 | 7/1924 | Thorsell . | |
| 1,917,464 | 7/1933 | Scharnowski | 446/243 |
| 2,646,644 | 7/1953 | Eichmond | 446/218 |
| 2,753,052 | 7/1956 | Brady . | |
| 2,985,976 | 5/1961 | Parker . | |
| 3,340,133 | 9/1967 | Krekovich . | |
| 3,417,505 | 12/1968 | Schultz | 446/112 |
| 3,747,263 | 7/1973 | Grossberg | 446/217 |
| 3,827,177 | 8/1974 | Wengel | 446/112 |
| 4,408,955 | 10/1983 | Wagle et al. . | |
| 4,669,164 | 6/1987 | Phelps . | |
| 4,884,328 | 12/1989 | Neighbors | 446/217 |
| 5,659,988 | 8/1997 | Kim et al. | 40/440 |
| 5,727,980 | 3/1998 | Stipa | 446/217 |
| 5,836,800 | 11/1998 | Liu | 446/236 |

*Primary Examiner*—Kien T. Nguyen
*Assistant Examiner*—Jeffrey D. Carlson

[57] ABSTRACT

There is disclosed a space accessory for forming a three-dimensional ornamental pattern. The space accessory includes a rotating center, necessary disk supports disposed along the rotating center and a predetermined number of vanes each having a design shape or pattern, said vanes being of the same shape, thickness and mass and fixed to the disk support for balanced rotation with a natural air current. For changes in the ornamental pattern of the space accessory there are only need in changes in the design or pattern of the vanes.

4 Claims, 4 Drawing Sheets

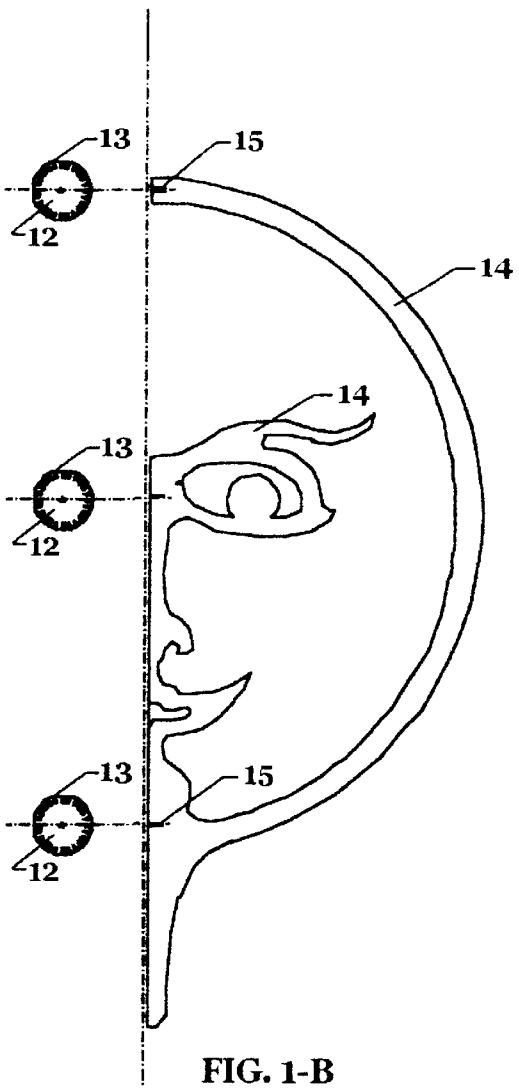
FIG. 1-B
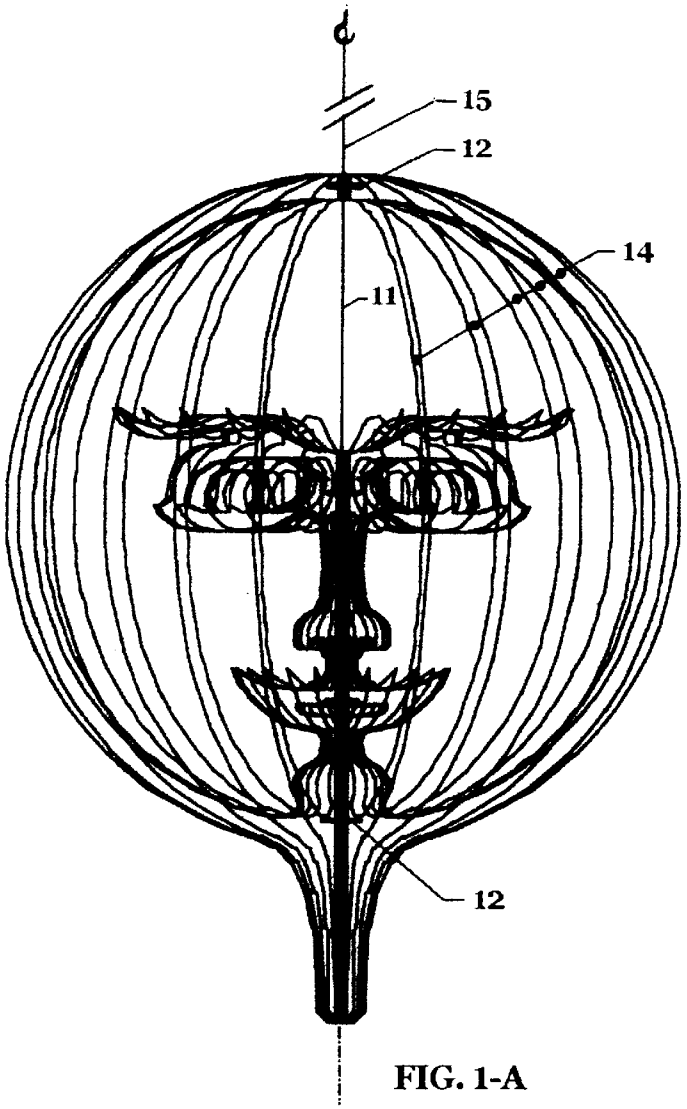
FIG. 1-A

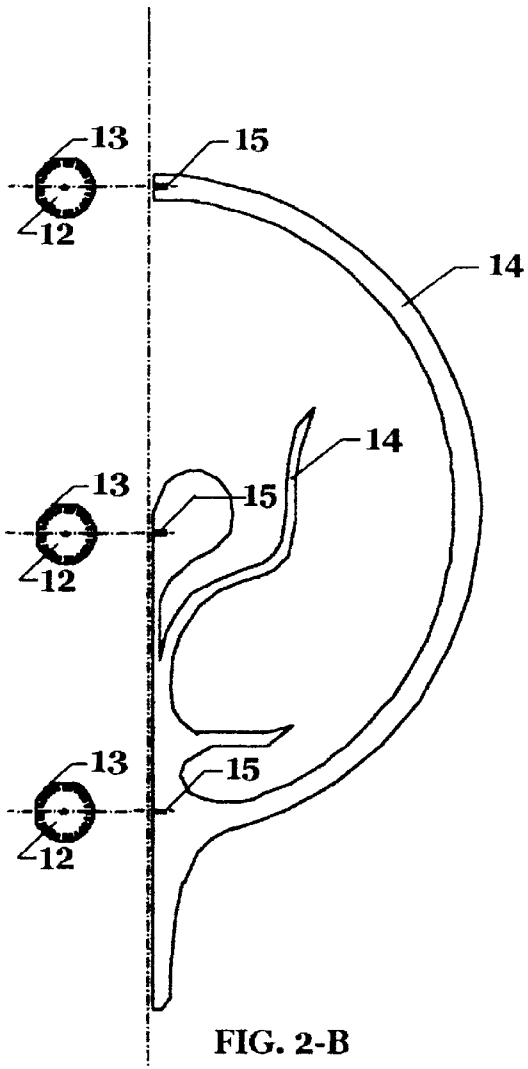
FIG. 2-B
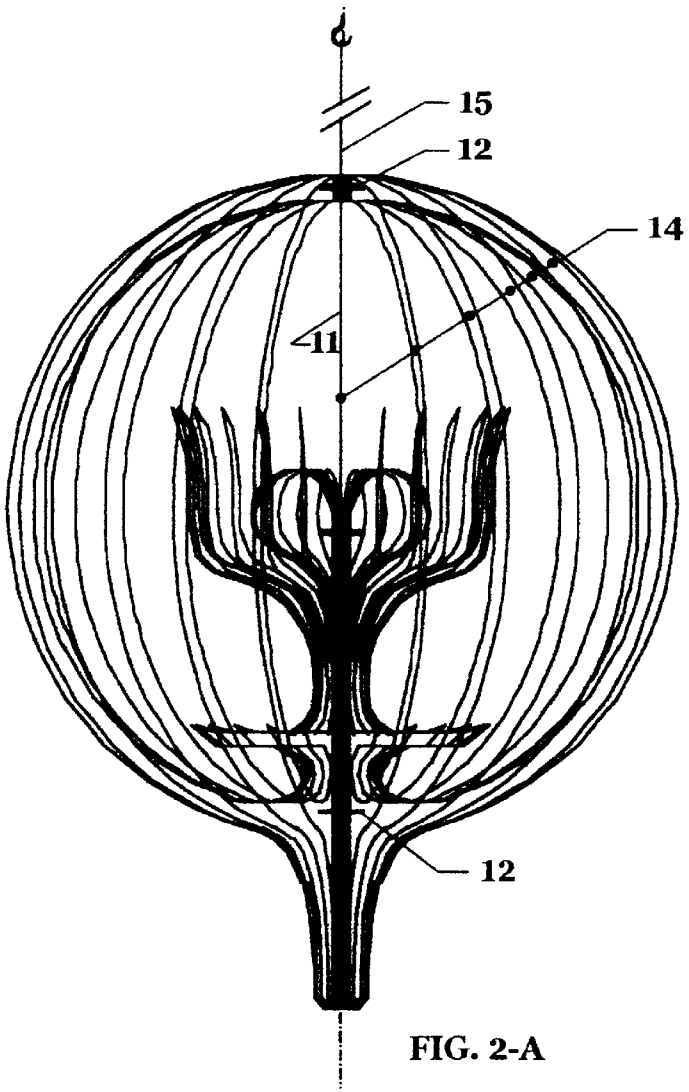
FIG. 2-A

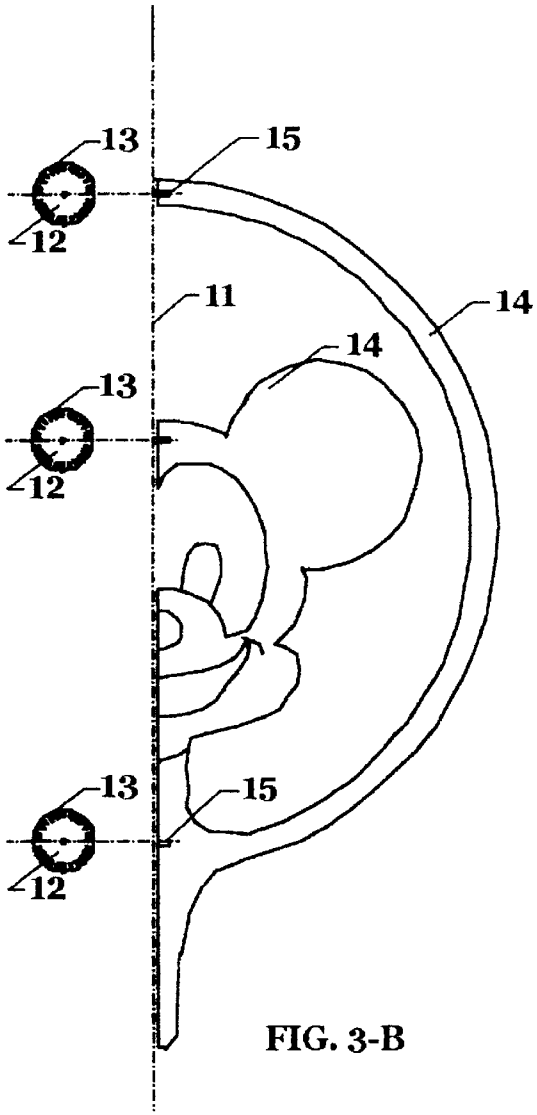
FIG. 3-B
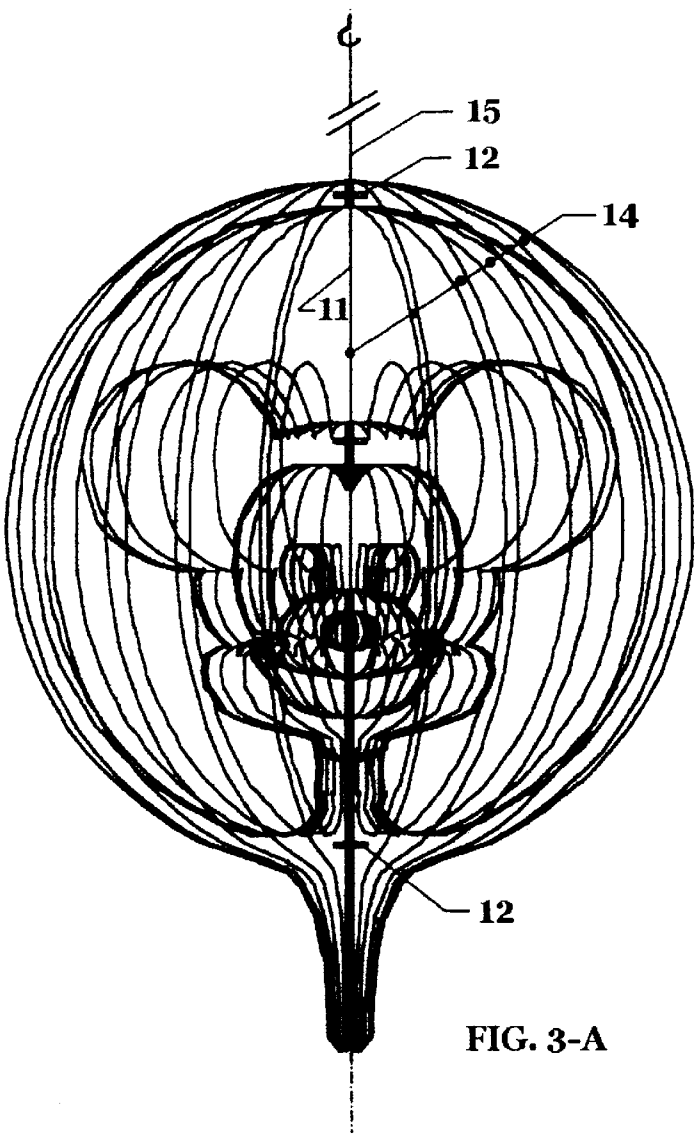
FIG. 3-A

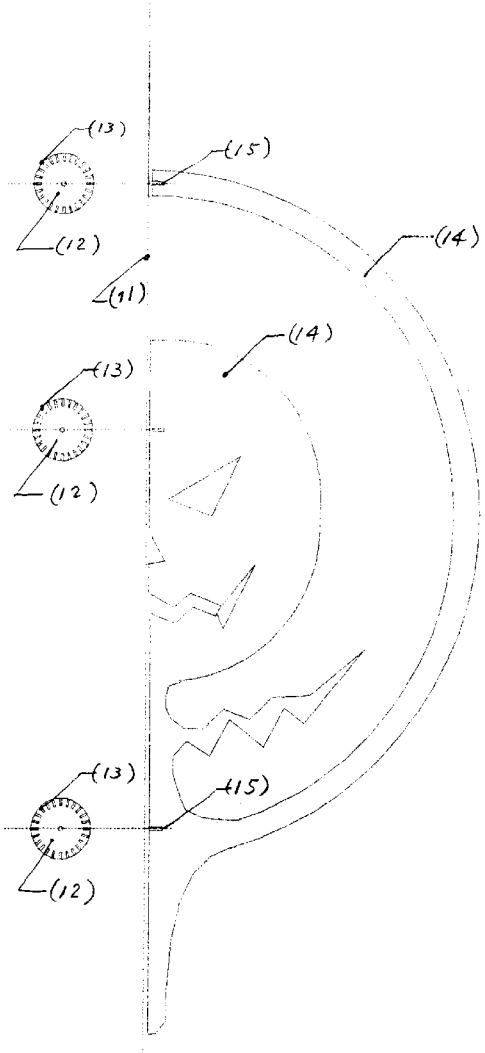
FIG. 4-B
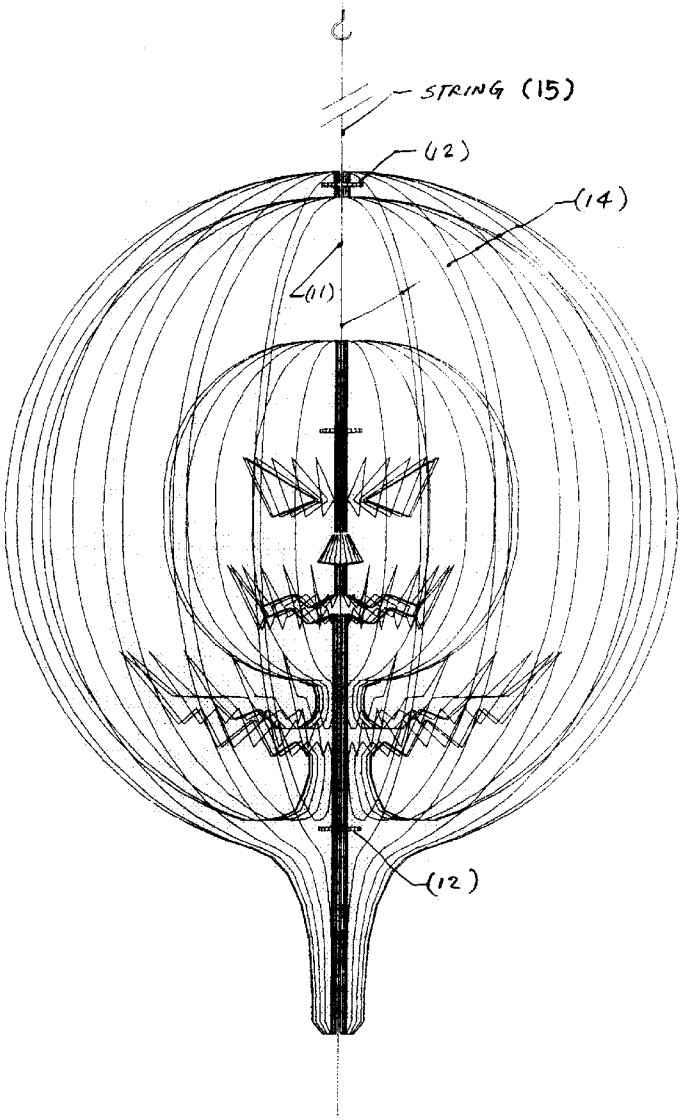
FIG. 4-A

SPACE ACCESSORIES

BACKGROUND OF THE INVENTION

This invention relates to space accessories and more particularly relates to interior and exterior space accessories which moves with a natural air current, that is, without a power drive.

Conventional space accessories are fixed at a certain location and those of a moving type are generally rotated by a source of power such as electric power supply. Ornamental patterns of the conventional space accessories are limited from accessory to accessory and changes in the ornamental patterns need to make and install new arrangements or mechanisms of space accessories. Since these space accessories usually use different types and shapes of material, changes in the ornamental patterns result in increase in manufacturing cost and final sales prices.

Accordingly, it is an object of the present invention to provide a novel space accessory which is easy to change ornamental patterns and easy to manufacture and assemble.

SUMMARY OF THE INVENTION

Pursuant to an aspect of the present invention, there is provided a space accessory which comprises a rotating center, at least two disk supports disposed along the rotating center and a predetermined number of vanes each having a design shape or pattern, said vanes being of the same shape, thickness and mass and fixed to the disk support for balanced rotation, whereby all of said vanes form an ornamental pattern in an attractive way (i.e., three-dimensional way), while rotating about the rotating center with a natural air current. For changes in the ornamental pattern of the space accessory there are only need in changes in the design or pattern of the vanes. The designs or patterns in a totality of the vanes may be a logo, character, trademark, trade name, or the like. With the natural air current, all of the vanes move and rotate to create a three-dimensional moving pattern as very attractive interior accessory or moving sculpture.

Further objects and advantages will become apparent from a consideration of the ensuing description and drawings.

BRIEF DESCRIPTION OF THE DRAWINGS

FIG. 1A is a front view of a whole assembly of 'a space accessory' according to a first embodiment of the present invention;

FIG. 1B is a plain view of a single piece vane;

FIG. 2A is a front view of a whole assembly of 'a space accessory' according to second embodiment of the present invention;

FIG. 2B is a plain view of a single piece vane;

FIG. 3A is a front view of a whole assembly of 'a space accessory' according to a third embodiment of the present invention;

FIG. 3B is a plain view of a single piece vane;

FIG. 4A is a front view of a whole assembly of 'a space accessory' according to a fourth embodiment of the present invention;

FIG. 4B is a plain view of a single piece vane;

DETAILED DESCRIPTION OF THE PRESENT INVENTION

With reference to the accompanying drawings, there are illustrated individual embodiments of the present invention.

In FIGS. 1–A&B, there is illustrated a first embodiment of the present invention. A space accessory according to the illustrated first embodiment of the present invention includes a rotating center 11 and disk supports 12 disposed on the rotating center 11. Each of the disk supports 12 has a predetermined number of radially oriented slots 13, the number of the slots 13 being identical with the number of patterned vanes 14. In the illustrated embodiment, the number of the patterned vanes 14 is twenty four 24 and the angular positions of the radically oriented slots 13 are 15 degrees apart.

The twenty four patterned vanes 14 are of the same shape, pattern, thickness and mass for balanced rotation with a natural air current and have recesses at three vertical positions 15 for insertion and fixing into the individual slots 13 in each of the disk supports 12. Appropriate fixing means such as adhesive is used for fixing the patterned vanes 14 into the disk supports 12. An appropriate thickness of the individual vanes 14 may be 1/16". An appropriate material for the individual vanes 14 may be acrylic resin and other plastic resin which may be molded with ease into one of a wide variety of design, pattern and color. Other materials for the vanes may include wood, metal, paper and a synthetic material. When all of the patterned vanes are assembled every 15 degrees into a rotating unit, they form a three-dimensional ornamental pattern. Although the assembling method is simple and same for all of the patterned vanes, the total ornamental pattern may be a selected one of a wide variety of patterns such as logos, animation characters, trademarks, trade names or the like.

In the illustrated embodiment, the top of the three disk supports 12 has a center hole by which the whole assembly may be hanged with a string 15 from a ceiling of a room on support above to cause balanced rotation with a natural air current.

It is noted that the space accessory according to the present invention takes any type of three-dimensional designed patterns. The first embodiment of the present invention shows a pattern of a human face. A second embodiment of the present invention as shown in FIGS. 2-A&B depicts an abstract shape and third and fourth embodiment of the present invention as shown in FIGS. 3A–3B and 4A–4B depicts a designed three shape of Mickey Mouse and Halloween Pumpkin.

The space accessory embodying the present invention is useful not only for an interior accessory but also exterior accessory. In the latter case, the space accessory may be used as advertising displayed media.

While the four different embodiments have been described, various modifications and substitutions may be made without departing from the spirit and scope of the invention. Therefore, it is understood that the present invention has been described by way of illustration and not limitation and the spirit and scope of the claims should not be limited to the description of the embodiments.

What is claimed is:

1. A rotating space accessory capable of being hung and spun by an air current comprising:

a number of unconnected identical planar vanes each being thin and flat and having the same shape including an outer edge boundary and an inner edge straight portion;

at least two planar support disks each having a number of symmetrically spaced outwardly extending radial slots, the disks arranged on a central axis and each slot securing a vane inner portion so that a three dimensional structure is created around the disks in a symmetric fashion, the flat face of the vanes being perpendicular to the planes of each disk;

the inner edge straight portions of the vanes each including an outwardly extending decorative profile inwardly spaced from the outer edge boundary so that when the space accessory is spun, the outer edges appear as a three-dimensional structure and the profiles extending from the inner edge portions appear as a three dimensional decoration symmetric about the central axis and spaced inwardly from the three-dimensional structure.

2. A space accessory as defined in claim 1 wherein said vanes are of the same shape, thickness and mass for balanced rotation.

3. A space accessory as defined in claim 1 wherein said vanes are made of plastic resin.

4. A space accessory as defined in claim 1 wherein said vanes are made of acrylic resin.

* * * * *